US006269495B1

(12) United States Patent
Sondrup

(10) Patent No.: US 6,269,495 B1
(45) Date of Patent: Aug. 7, 2001

(54) ADJUSTABLE FLOOR DRAIN APPARATUS

(75) Inventor: Chris Sondrup, Lindon, UT (US)

(73) Assignee: C&D Innovations, L.C., Lindon, UT (US)

( * ) Notice: Subject to any disclaimer, the term of this patent is extended or adjusted under 35 U.S.C. 154(b) by 0 days.

(21) Appl. No.: 09/587,857

(22) Filed: Jun. 6, 2000

(51) Int. Cl.[7] ..... E03C 1/12

(52) U.S. Cl. ..... 4/679; 4/286; 4/613; 4/695; 285/261; 285/262; 210/163

(58) Field of Search ..... 4/252.3, 252.4, 4/286, 613, 679–681, 688, 692, 695; 285/261, 262, 271; 210/163, 164

(56) References Cited

U.S. PATENT DOCUMENTS

| | | | | |
|---|---|---|---|---|
| 1,779,936 | * | 10/1930 | Hess | 210/163 |
| 2,190,532 | * | 2/1940 | Lukomski | 4/679 |
| 3,420,552 | * | 1/1969 | Mork | 4/679 |
| 4,273,467 | | 6/1981 | Cronk . | |
| 4,337,005 | | 6/1982 | LeBaron . | |
| 4,879,771 | * | 11/1989 | Piskula | 4/286 |
| 4,883,590 | | 11/1989 | Papp . | |
| 5,044,674 | | 9/1991 | Hendrickson . | |
| 5,366,317 | | 11/1994 | Solimar . | |
| 5,451,119 | | 9/1995 | Hondulas . | |
| 5,470,172 | | 11/1995 | Wiedrich . | |
| 5,496,128 | | 3/1996 | Odill . | |
| 5,564,855 | | 10/1996 | Anderson . | |
| 5,956,905 | | 9/1999 | Wiedrich . | |

FOREIGN PATENT DOCUMENTS

| | | | | |
|---|---|---|---|---|
| 6-322804 | * | 11/1994 | (JP) | 285/262 |

* cited by examiner

*Primary Examiner*—Gregory L. Huson
*Assistant Examiner*—Tuan Nguyen
(74) *Attorney, Agent, or Firm*—Thorpe North & Western

(57) ABSTRACT

An adjustable drain apparatus to be positioned with a floor therearound. The drain has a drain channel, having an upper end to receive fluid, and a lower end to expel the fluid. The drain also has a base, positioned proximate to the drain channel, having a cavity to receive the fluid expelled from the lower end. Additionally, the drain has pivoting means, coupled to the lower end of the drain channel, for enabling pivoting of the drain channel relative to the base. Moreover, there is a securing means for pivotally securing the pivoting means to the base. Uniquely, the securing means comprises a pair of plates, each having an inner concentric substantially spherical surface designed to mate with the pivoting means and be coupled to the base. Also, the pivoting means comprises a ring having an inner surface that is attached to the lower end of the drain channel, and an outer spherical surface designed to smoothly pivot against the spherical surfaces of the pair of plates. Additionally, the securing means holds the pivoting means away from a surface of the cavity of the base. Moreover, the securing means has a first configuration that holds the pivoting and drain channel in a first position and has a second configuration that holds the pivoting and drain channel in a second position that is higher than the first position relative to the base.

9 Claims, 3 Drawing Sheets

ADJUSTABLE FLOOR DRAIN APPARATUS

RELATED APPLICATIONS

The following related applications are currently pending, "Adjustable Floor Drain Apparatus" filed on May 8, 2000 and "Adjustable Pipe Connector" filed on May 9, 2000 both by the same inventor, Chris Sondrup.

THE FIELD OF THE INVENTION

The present invention relates generally to drains. More particularly, the present invention relates to a drain which is adjustable in height and pitch to allow the top of the drain to conform to the pitch of a surrounding surface, such as a floor.

BACKGROUND ART

Floor and shop drains have been known and used for many years. A floor drain in its simplest form funnels liquids from a floor surface into a drain pipe. Typically floor drains have a grate attached to their top to allow liquid to flow but to prevent larger solid objects from entering the floor drain.

Drains found in restroom facilities, showers, kitchen floors and shop floors are used to drain liquids such as shower water or waste water. The problem with prior art drains is that they are often installed in floor surfaces that are neither level, flat, nor perpendicular to the drain pipe to which the drains must connect. Drains need to be at a proper height and level with the surfaces surrounding them in order to function properly. Drains which are not properly placed relative to surrounding surfaces also can pose a safety threat. In the prior art, it has been difficult and time-consuming to properly install level drains.

As mentioned, one problem associated with the construction of floor drains is the problem of being able to align the drain and grating with the portion of the floor around it. Adjusting mechanisms have not been available to accomplish this result without inordinate trouble and expense. Often, the floor drain does not conform precisely to and is not in alignment with the top of the floor. Even the adjustable floor drains which exist do not fully meet the needs of plumbing installation professionals.

One patent which illustrates an adjustable floor drain is U.S. Pat. No. 4,883,590 to Papp. The device designed by Papp is an adjustable floor drain having an outer cylindrically shaped body with threads on the inside thereof attached to the top of a drain pipe. A cylindrical member is disposed inside of the outer body so that concrete can be poured around the cylindrical member and the concrete will not enter the outer body. An inner cylindrically shaped body having threads on the exterior thereof is provided for mating with the inside threads on the outer body whereby the inner body can be threaded into the outer body and whereby the top thereof can be adjusted up or down to conform to the height of the finished floor. A ring is adapted to engage the top of the the inner body, and the ring has a partially spherical surface around the lower periphery thereof which contacts the top of the inner body, which also has a complementary shaped partial spherical surface thereon for providing a mating slidable joint between the ring and the inner body. A grate is disposed in a recess on the ring, and an optional basket strainer can be installed under the grate.

Consequently, there is a need for an improved floor drain apparatus which will easily and quickly allow for vertical and angular horizontal adjustment. Additionally, there is a need for an adjustable drain which is simple to use and which allows a plumbing installer to quickly and easily install a drain that is level with the surrounding surfaces.

INVENTION SUMMARY

It is therefore a feature of the present invention to provide a drain. More particularly, the present invention relates to a drain that is adjustable in height and pitch to allow the top of the drain to conform to the pitch of the surface of the floor.

A further feature of the invention is to provide an adjustable drain apparatus to be positioned with a floor therearound. The drain has a drain channel, having an upper end to receive fluid, and a lower end to expel the fluid. The drain also has a base, positioned proximate to the drain channel, having a cavity to receive the fluid expelled from the lower end. Additionally, the drain has pivoting means, coupled to the lower end of the drain channel, for enabling pivoting of the drain channel relative to the base. Moreover, there is a securing means for pivotally securing the pivoting means to the base. Uniquely, the securing means comprises a pair of plates, each having an inner concentric substantially spherical surface designed to mate with the pivoting means and be coupled to the base. Also, the pivoting means comprises a ring having an inner surface that is attached to the lower end of the drain channel, and an outer spherical surface designed to smoothly pivot against the spherical surfaces of the pair of plates. Additionally, the securing means holds the pivoting means away from a surface of the cavity of the base. Moreover, the securing means has a first configuration that holds the pivoting and drain channel in a first position and has a second configuration that holds the pivoting and drain channel in a second position that is higher than the first position relative lo the base.

There has thus been outlined broadly the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

It is noted that the drawings of the invention are not to scale. The drawings are merely schematic representations, not intended to portray specific parameters of the invention. The drawings are intended to depict only selected embodiments of the invention, and therefore should not be considered to be limiting the scope of the invention. The invention will be described with additional specificity and detail through the use of the accompanying drawings. Corresponding numbering between the figures represents corresponding elements.

DETAILED DESCRIPTION OF THE DRAWINGS

Figure 1:
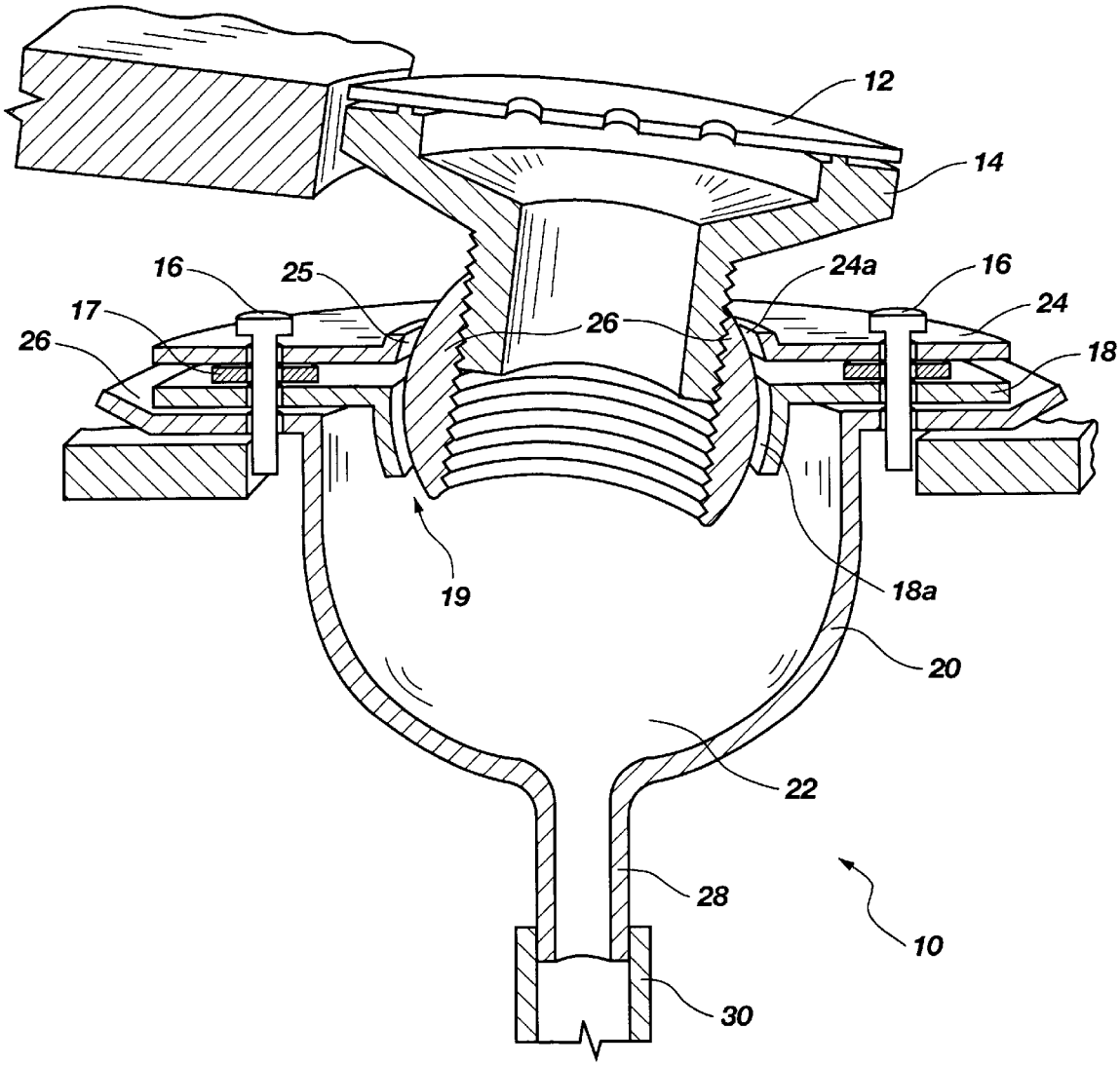
FIG. 1 is a cross-sectional perspective side view of an embodiment of a vertically and angularly adjustable floor drain.

Referring to FIG. 1, a cross-sectional side view of an embodiment of the adjustable floor drain apparatus is illustrated. Specifically, there is an adjustable floor drain 10, that has a surface grate ("grate") 12 supported by a funnel member 14 or connector channel, which mates with threads on a rounded ring or pivot member 26. The ring 26 rests in a first plate 18 positioned about the ring. The first plate has a lower substantially spherical surface 18*a* forming a first cavity 19 designed to mate with the spherical surface of the ring and support the ring. A drain base 20 includes a drain cavity 22, and the first plate is configured to be secured to the drain base and to close the drain cavity to securely hold the ring. A second plate 24 is also positioned about the ring, having an upper substantially spherical surface 24*a* forming a second cavity 25, designed to mate with the upper spherical surface of the ring.

The upper spherical surface 24*a* of the second plate 24 (which forms the second cavity 25) is used to securely hold the ring against the lower spherical surface. The upper spherical surface should be configured such that it rests on the top portion of the ring with a significant gap between the lower spherical surface (and the first cavity 19) of the first plate. This way the second plate is secured over the first plate and both plates are secured to the base 20 using the bolts 16. Both the first and second plates surround a portion of funnel 14, and each has holes to permit securing bolts 16 to secure the plates to the drain base 20. The drain base has threads which mate with bolts, and a lip 26 positioned to support the first and second plates. Washers 17 can be used to space the first and second plates apart. Although the washers are optional, they are useful in providing spacing to allow the first and second plates to better hold or grip the ring. A drain channel 28 on a lower portion of the base is designed to connect to the drain pipe 30. It is further noted that the drain channel can also have a pipe connected to it using a threaded connection.

Figure 2:
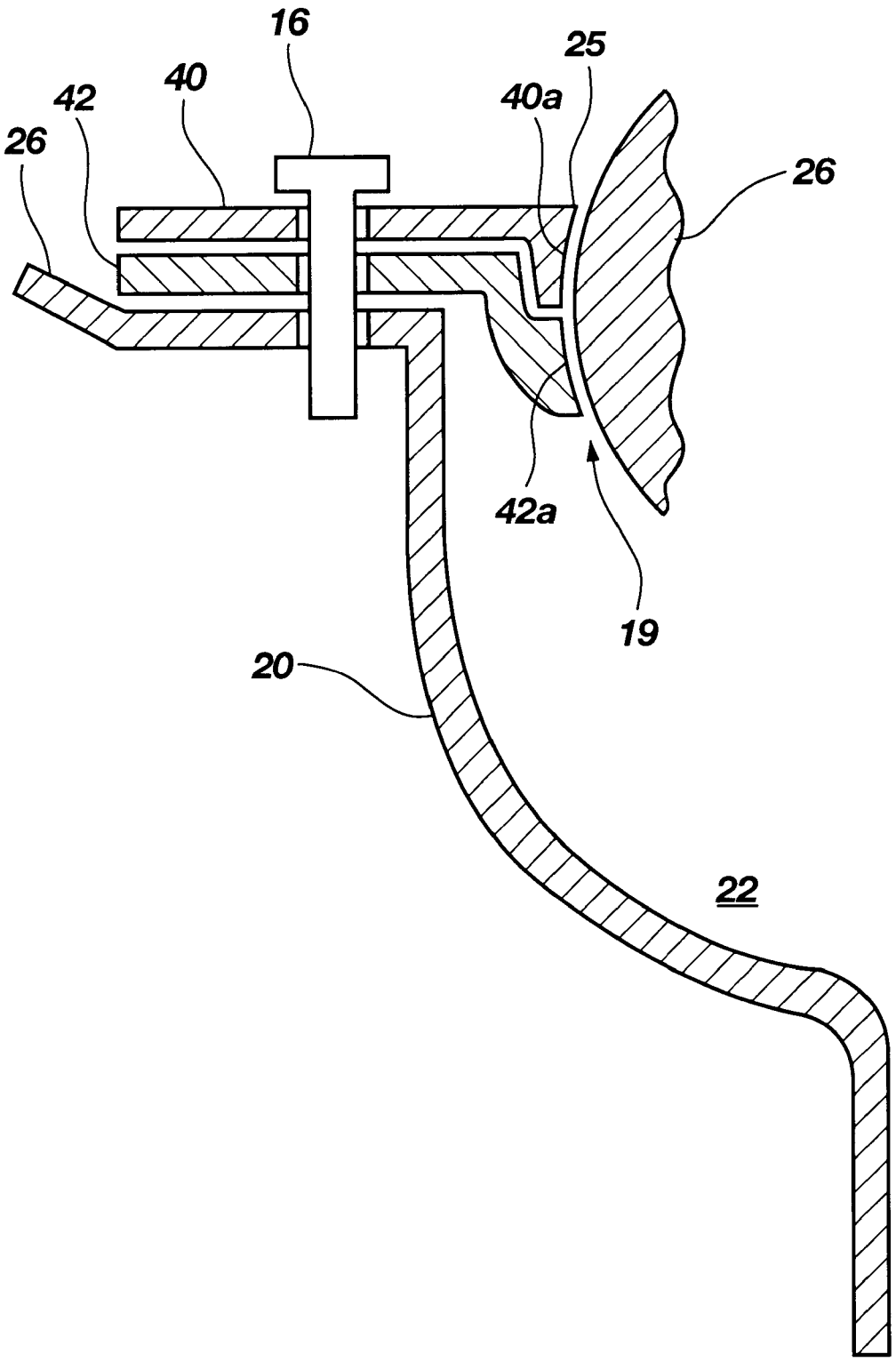
FIG. 2 is a cross-sectional orthogonal side view of a selected portion of another embodiment of a vertically and angularly adjustable floor drain.

FIG. 2 depicts an orthogonal cross-section side view of selected elements of one configuration of an adjustable drain. For simplicity, only the left side of the drain is shown and the right side mirrors the left side. Centerline 27 is the centerline of ring 26 when positioned level to the rest of the drain 10. The ring 26 rests in a first plate 42, and is positioned circularly about the ring 26 to be held rotatably therein. The first plate has a lower spherical surface 42*a* forming a first cavity 19 designed to mate with the spherical surface of the ring and support the ring 26. A drain base 20 includes a drain cavity 22, and the first plate is configured to be secured to the drain base and to close the drain cavity to securely hold the ring.

A second plate 40 would also be positioned about the ring. The second plate has an upper substantially spherical surface 40*a* forming a second cavity 25, designed to mate with the upper spherical surface of the ring. As illustrated, the second plate is secured over the first plate and both plates are secured to the base 20 using the bolts 16. This interlocking spherical surface configuration 40*a* and 42*a* is significant because it allows the spherical surfaces of the plates to interlock and form a strong connector or holder for the ring.

Figure 3:
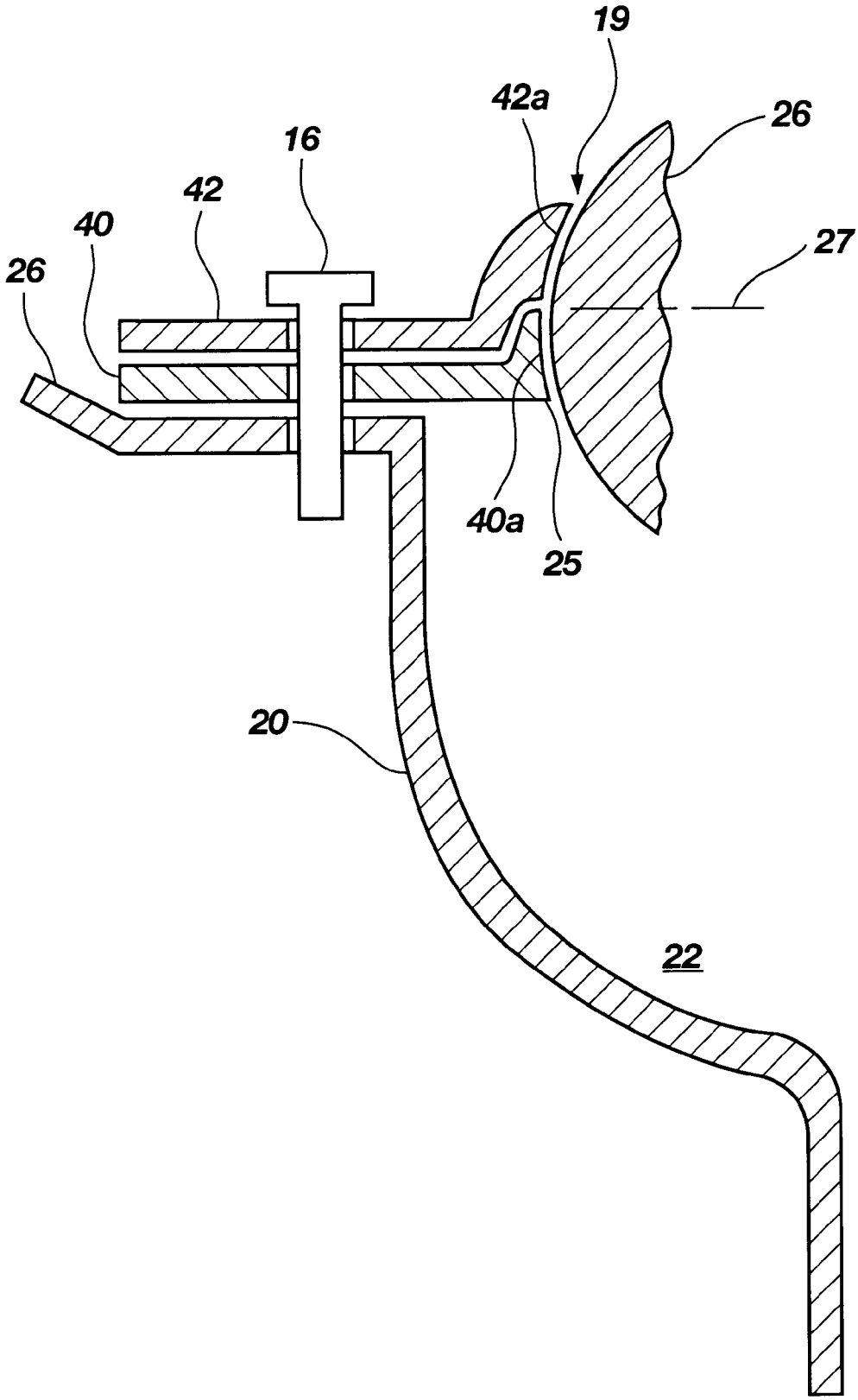
FIG. 3 is a cross sectional view of one half of another embodiment of the preferred embodiment.

FIG. 3 is a cross sectional view of one half of another embodiment of the preferred embodiment. Specifically, centerline 27 illustrates that the centerline of ring 26 is located higher relative to the base 20 than is possible in FIG. 2. Of course, one skilled in the art will realize that the size of the plates 40 and 42 can be enlarged to increase the height adjustment as a result of flipping over the two plates over. This gross height adjustment is accomplished by simply flipping over the first and second plates. Again, if the plate surfaces 40*a* and 42*a* are made larger, the height difference would much larger by simply flipping over the plate arrangements.

It is noted that all designs of the preferred embodiments, drain 10 has ring 26 suspended above the surface 22 of the base 20. This is needed since many commercial bases are made of material that is often rough on the surface 22. The typical rough surface 22 would prevent ring 26 from smoothly rotating in adjusting grate 12. Thus, a skilled plumbing designer will appreciate the fact that the plates 40 and 42 and the ring 26 can be made of material that allow for smooth rotation or adjustment without having to rub against the rough base surface 22.

Variations of the Preferred Embodiment

One skilled in the art would be capable of making many obvious design changes which would stay within the scope of the invention disclosed in this application. One such change would be to vary the size or scale of components such as the surface grate, funnel member, bolts, ring, drain base, first plate, and second plate used in the apparatus.

It would be obvious to one skilled in the art to use a securing means other than threads on the funnel member and on the ring pivot member to affix the two parts. For example, adhesives or glues also could be used, while still allowing for vertical and pitch adjustment of the drain.

The first plate and second plate can be fused together to create just one plate with a partially spherical inner edge to mate with the ring. This configuration allows the ring to be either permanently held within the inner edge or snapped into the inner edge before the drain is installed.

Though bolts are illustrated, most any means of attaching the plate to the base will work, so long as sufficient pressure can be used to secure the ring in place to prevent unwanted rotation of the drain once installed into the floor.

Although the drain illustrates a certain surface shape. any shape drain can be used. The main advantage of the preferred embodiment is the installation of the ring to allow for angular movement or tilting. However, it is important to note that the tilting is useful to either the grate or to the drain channel. Specifically, the drain channel is not always perfectly aligned with the floor, and the ability to tilt the coupling is a great advantage and time saver. Therefore, it is contemplated to have a level grate or floor and a tilted base 20, which is the opposite of what is illustrated in FIG. 1.

Numerous modifications and alternative arrangements can be devised by those skilled in the art without departing from the spirit and scope of the present invention, and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

What is claimed is:

1. An adjustable drain apparatus for positioning within a surrounding floor, comprising:

a) a grate, configured to allow fluid to drain therethrough;

b) a connector channel, having an upper end coupled to the grate, and a lower end;

c) a ring, having:

1) an inner surface that is attached to the lower end of the connector channel, and 2) an outer substantially spherical surface;

d) a first plate, positioned about the ring, having a first cavity with a substantially spherical surface that is designed to mate with the spherical surface of the ring and to rotatably hold the ring, wherein the grate can be tilted relative to the plate;

e) a second plate, secured to the first plate, having a second cavity for positioning the ring therein; and f) a drain base, having a drain cavity and cavity surface formed therein, wherein the first and second plates are secured to the drain base to close the drain cavity and separate the ring and connector channel from the cavity surface; and g) the first and second plates being designed to hold the ring in:

1) a first position when the first plate is positioned below the second plate, and 2) a second position when the first plate is positioned above the second plate so as to hold the ring and connector channel higher than the first position relative to the base.

2. An apparatus in accordance with claim 1, wherein the connector channel has threads positioned therearound, and the ring has threads positioned on the inner surface so that the connector channel can be threaded into the ring.

3. An apparatus in accordance with claim 1, wherein the first and second plates are secured to the drain base by bolts.

4. An adjustable drain apparatus to be positioned with a floor therearound, comprising;

a) a drain channel, having an upper end to receive fluid, and a lower end to expel the fluid;

b) a base, positioned proximate to the drain channel, having a cavity to receive the fluid expelled from the lower end;

c) pivoting means, coupled to the lower end of the drain channel, for enabling pivoting and tilting of the drain channel relative to the base; and d) a pair of plates, coupled to the base, each having an inner surface designed to mate with the pivoting means, the pair of plates having:

1) a first configuration that holds the pivoting means and drain channel in a first position, and 2) a second configuration that holds the pivoting means and drain channel in a second position that is higher than the first position relative to the base.

5. The drain of claim 4, further comprising a grate, attached to the upper end of the drain channel designed to allow fluid to drain therethrough.

6. The drain of claim 4, wherein the pivoting means comprises a ring having an inner surface that is attached to the lower end of the drain channel, and an outer spherical surface designed to smoothly pivot against the inner surfaces of the pair of plates.

7. The drain of claim 6, wherein the pair of plates holds the ring away from a surface of the cavity of the base.

8. The drain of claim 4, wherein the pair of plates holds the pivoting means away from a surface of the cavity of the base.

9. The apparatus in accordance with claim 4, wherein the plates are secured to the drain base by bolts.

* * * * *